US005911766A

United States Patent [19]

Lieb et al.

[11] Patent Number: 5,911,766

[45] Date of Patent: Jun. 15, 1999

[54] LOCK CYLINDER

[75] Inventors: Kurt Lieb, Seligenstadt; Stephan Chevalier, Stralsund; Martin Richter, Maintal; Thomas Hering, Essen, all of Germany

[73] Assignee: Valeo GmbH & Co. Schliesssysteme KG

[21] Appl. No.: 08/936,579

[22] Filed: Sep. 24, 1997

[30] Foreign Application Priority Data

Sep. 25, 1996 [DE] Germany ..... 196 39 249

[51] Int. Cl.[6] ..... E05B 15/16

[52] U.S. Cl. ..... 70/422; 70/379 R

[58] Field of Search ..... 70/419–422, 356, 70/491, 492, 379 R

[56] References Cited

U.S. PATENT DOCUMENTS

| | | | |
|---|---|---|---|
| 4,856,310 | 8/1989 | Parienti | 70/379 R |
| 5,265,453 | 11/1993 | Konii et al. | 70/379 R |
| 5,640,864 | 6/1997 | Miyamoto | 70/379 R |

FOREIGN PATENT DOCUMENTS

| | | |
|---|---|---|
| 40 41 134 | 6/1992 | Germany . |
| 43 04 873 | 8/1994 | Germany . |
| 44 10 783 | 4/1995 | Germany . |

*Primary Examiner*—Steven Meyers
*Assistant Examiner*—Teri Pham
*Attorney, Agent, or Firm*—Morgan & Finnegan, LLP

[57] ABSTRACT

The invention concerns a lock cylinder with a cylinder core arranged rotatable in a housing and an overload coupling device, which consists of at least one radially slidable tang which is connected non-rotatable to the cylinder core, as well as of a control element cooperating with the tang in case of overload. In order to establish that the control element, in the case of overload, causes a radial shifting of the tang in a simple and certain way and thereby a decoupling of the cylinder core from the output element, the invention proposes using, as the control element, a ring shaped element which is arranged non-rotatable, but longitudinally slidable in the housing, and which also has diagonal guide surfaces on both the side facing its cylinder liner and on its side facing the tang, which support themselves on the corresponding guide surfaces of the cylinder liner and tang, respectively, so that a rotational movement of the cylinder liner leads to an axial shifting of the control ring, which then causes a radial shifting of the tang.

14 Claims, 2 Drawing Sheets

FIG.1
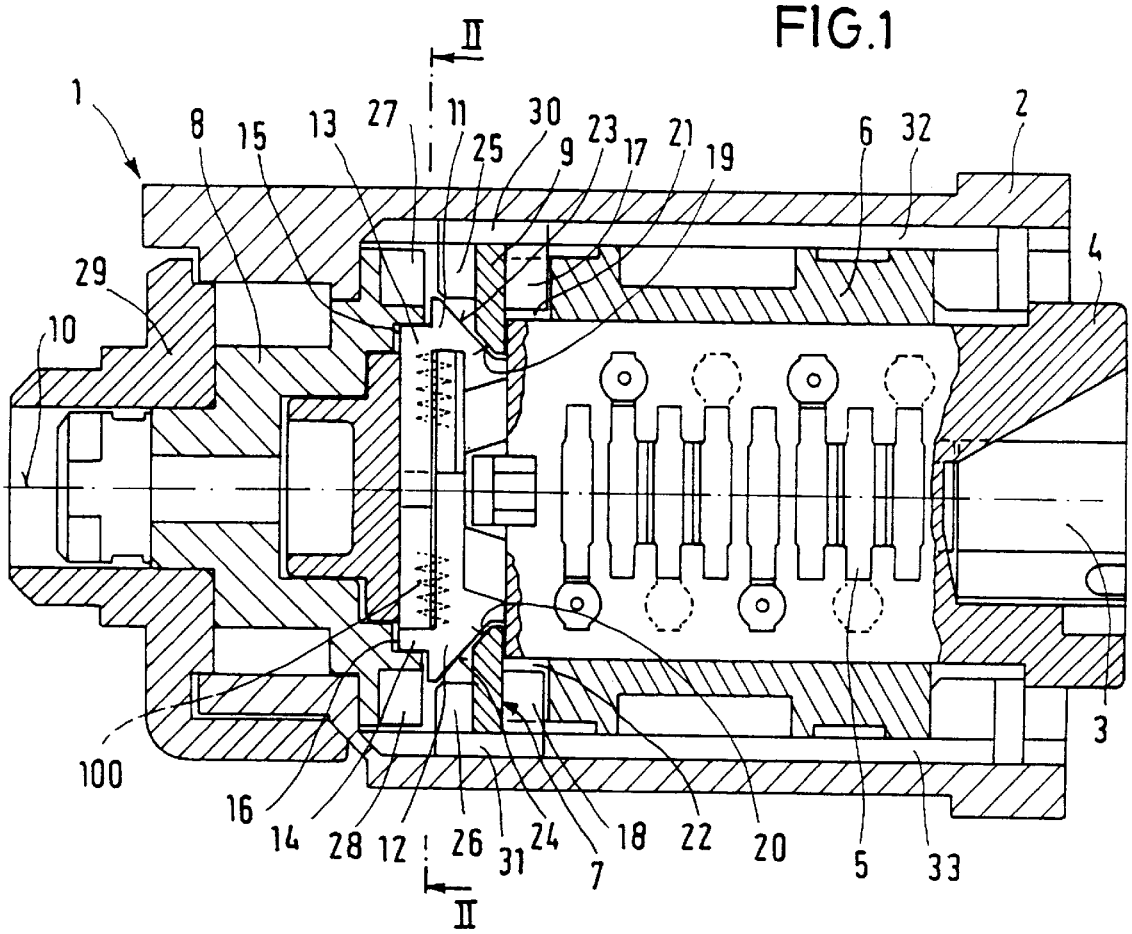
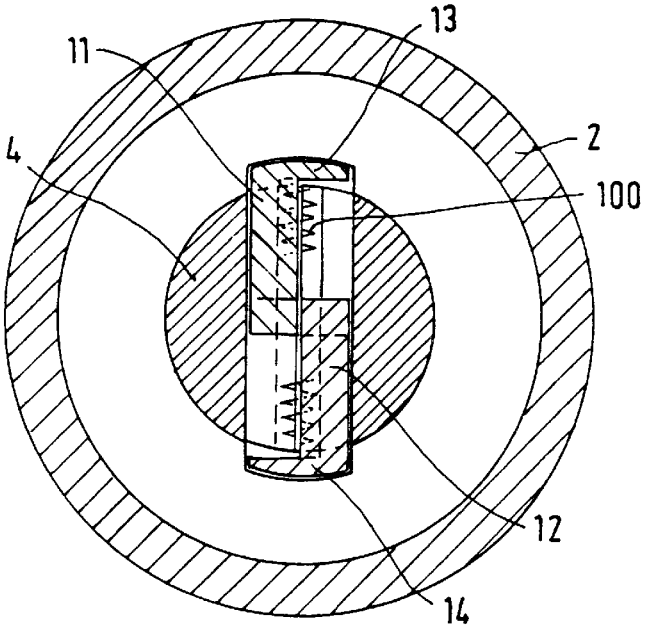
FIG.2

FIG. 3
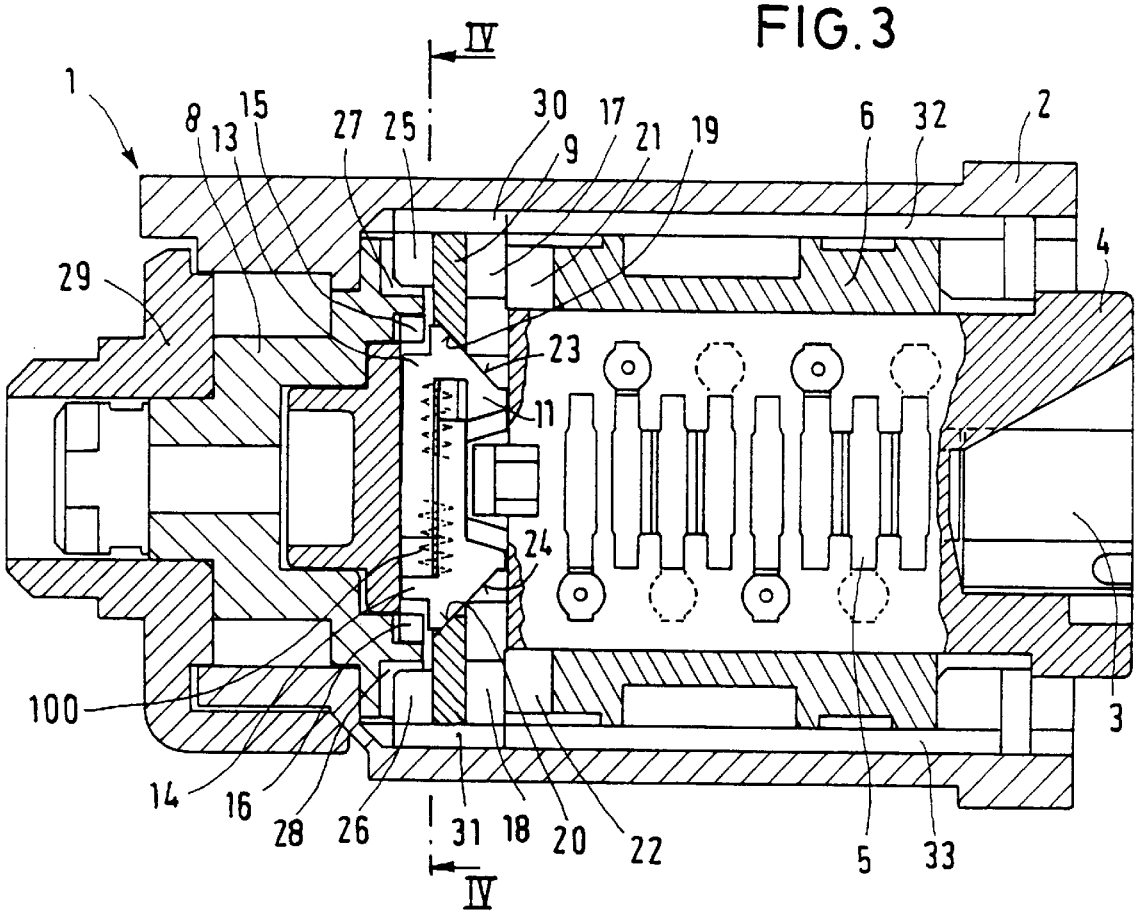
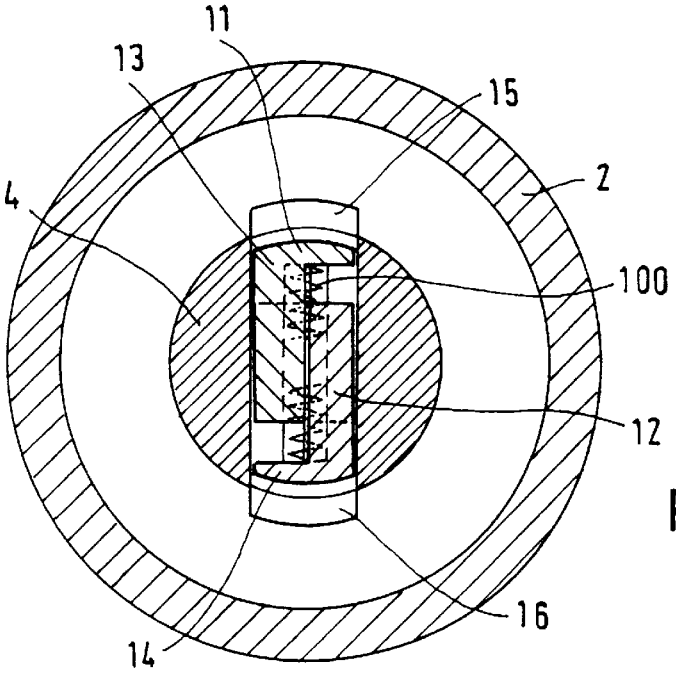
FIG. 4

LOCK CYLINDER

BACKGROUND OF THE INVENTION

The invention concerns a lock cylinder with the characteristics given under the heading of claim 1.

BRIEF SUMMARY OF THE INVENTION

A lock cylinder of this type is well known, as for example, from DE 40 41 134 C1 and EP 0 611 860 A1. It contains a housing with a cylinder core which is arranged rotatable in the housing, which has a key channel, and which, upon a key's withdrawal from the key channel, can be latched with a cylinder liner, arranged between housing and cylinder core, by tumblers. Additionally, an overload coupling device is provided, so that the output element connected to the lock is decoupled from the cylinder core when cylinder core is turned by an improper key or tool. The overload coupling device consists of at least one tang, which is radially slidable and connected non-rotatable to the cylinder core, supports itself on the output element in a radially outward direction, and engages into a driving slot of the output element, and of a control element which works with the tang in case of overload. The control element concerns a tappet which is mounted in a radial sparing of the housing and is provided with control surfaces and which is pressed out of the radial sparing by the rotation of the cylinder liner and shifts the tang radially.

Among other things, the relatively expensive steering of the tang by the control element which is mounted in the housing's radial sparing and which shifts itself radially in the case of overload is disadvantageous for the well known lock cylinder.

A lock cylinder with an overload coupling device is furthermore known from DE 44 10 783 C1. It contains a tang which is solidly connected to the cylinder core and which engages in a driving slot of the corresponding axially slidable output element. Furthermore, the end face of the cylinder liner of the lock cylinder was inserted for "lock cylinder's cylinder liner's end face"; which faces the output element, is provided with a control surface, which is engaged by a catch element fastened to the output element, in such a way that, in case of overload, the output element is axially shifted when the cylinder liner rotates, and the tang and driving slot are separated from each other.

The invention takes as its basis, the task of making a lock cylinder of the type mentioned at the beginning, in which the control element working with the tang in the case of overload effects a radial shifting of the tang in a simple and certain manner.

In accordance with the invention, this task is solved by the characteristics of the body in claim 1. The subclaims disclose other particularly advantageous embodiments of the invention.

The invention is essentially based on the idea of using as control element, a ring-shaped element which is arranged non-rotatable but longitudinally slidable in the housing and has diagonal guide surfaces on both the side facing the cylinder liner and the side facing the tang which support themselves on the corresponding guide surfaces of the cylinder liner and tang, respectively. If an invalid key is used, then the cylinder liner twists itself at the beginning of a defined torque and shoves the control ring axially in the direction of the output element because of the diagonal guide surfaces. Simultaneously, the tang is shifted radially toward the lock cylinder's center line by the connection between control ring and tang, likewise consisting of diagonal guide surfaces, and the output element is mechanically decoupled from the cylinder core so that the transfer of torque from the key to the output element is broken.

So that an adequate application of force will not lead to damage of housing or of the control ring which is arranged non-rotatable on the housing, the length of the guide surfaces between the cylinder liner and control ring in the axial direction is chosen in such a manner that the two parts are disengaged after a preset rotation of the cylinder liner.

In an advantageous embodiment of the invention, at least one catch element, which aligns with a corresponding recess of the output element, is arranged on the control ring on the side turned away from the cylinder liner. The control ring's catch element is shoved into this recess in the case of overload. Thereby a possible rotational motion of the output element, and of the mechanical connection element between the output element and the lock, are both blocked. In this case, manipulation from the lock cylinder's back side thus does not lead to an unlocking motion of the lock connected to the lock cylinder.

BRIEF DESCRIPTION OF THE DRAWINGS

Additional details and advantages of the invention are given in the following examples which are explained on the basis of figures. These show:

FIG. 1 shows a longitudinal section through a lock cylinder with overload coupling, in its standard state, in accordance with the invention;

FIG. 2 shows a cross section through the lock cylinder illustrated in FIG. 1 along the line labeled II—II there;

FIG. 3 shows the longitudinal section of a lock cylinder corresponding to FIG. 1, if the overload coupling is in its freewheeling state, and FIG. 4 shows a cross section through the lock cylinder illustrated in FIG. 3 along the line labeled IV—IV there.

DETAILED DESCRIPTION OF THE INVENTION

In FIG. 1, a lock cylinder, for the locking mechanism of a motor vehicle's door, for example, is labeled 1. The lock cylinder 1 contains a cylinder core 4, which is arranged rotatable in a housing 2, and which has a key channel 3. In the latched state of the lock cylinder 1, the cylinder core 4 is connected non-positive to a cylinder liner 6, arranged between the housing 2 and cylinder core 4, by tumblers 5.

On the side turned away from the key channel 3, the cylinder core 4 is connected to an output element 8, which operates on an unillustrated locking device of a motor vehicle's door, by an overload coupling device 7.

The overload coupling 7 consists of a ring-shaped control ring 9, which is mounted in the housing 2, axially slidable but non-rotatable with respect to the longitudinal axis 10 of the lock cylinder 1, and of two radial tangs 11, 12, which are radially slidable against the pressure of a spring 100, connected non-rotatable to the cylinder core 4, and which support themselves externally on the output element 8 and engage the corresponding sparings 15, 16 of the output element 8 with dog-shaped projections 13, 14.

The control ring 9 has diagonal guide surfaces 17, 18 and 19, 20 on the side facing the cylinder liner and the side facing the tang, respectively, which support themselves on the corresponding guide surfaces of the cylinder liner 21, 22 and tang 23, 24, respectively.

So that an adequate application of force does not lead to damage of the housing 2 or of the control ring 9 which is arranged non-rotatable on the housing 2, the length of the guide surfaces 21, 22, of the cylinder liner 6, and the guide surfaces 19, 20 of the control ring 9 in the axial direction is chosen in such a manner that the two parts 6, 9 are disengaged after a preset rotation of the cylinder liner 6.

Dog-shaped projection catch elements 25, 26, which align with corresponding recesses 27, 28 of the output element 8, are arranged on the control ring 9 on the side turned away from the cylinder liner 6. The catch elements 25, 26 of the control ring 9 are shoved into these recesses 27, 28 in the case of overload. Thereby a possible rotational motion of the output element, and of the mechanical connection elements 29 between the output element 8 and the lock, are both blocked. In this case, manipulation from the lock cylinder's back side thus does not lead to an unlocking motion of the lock connected to the lock cylinder.

The operation of the lock cylinder in accordance with the invention will be explained in more detail in the following. In this discussion, the lock cylinder is supposed to be in the standard state illustrated in FIGS. 1 and 2.

If a key which fits is placed into the key channel 3 and a torque is begun, then the tumblers 5 are pulled out of the corresponding recesses of the cylinder liner 6. A rotation of the cylinder core 4 in the lining 6 is now possible. The two tangs 11, 12 which are arranged in the cylinder and move in opposite directions, engage the sparings 15, 16 of the output element 8 provided for them and transfer the torque required for opening to the doorlock through the connection element 29, connected non-rotatable to the output element 8.

If an invalid key is used, the tumblers 5 are not pulled out of the corresponding recesses of the cylinder liner 6. A connection of the cylinder core 4 to the liner 6 continues to exist. Upon introduction of a defined torque, the cylinder liner 6 twists itself in the housing 2 and steers the control ring 9 out in an axial direction across the guide surfaces 21, 22 fashioned on the face turned away from the key channel 3. Additionally, peripheral cams 30, 31, arranged on the outer circumference of the control ring 9, catch into axially running guide notches 32, 33 of the housing, so that the control ring is guided into the housing without rotating.

Through its longitudinal shifting, the control ring 9 steers the tangs 11, 12, moving in opposite directions, inwards across the guide surfaces 19, 23 and 20, 24, respectively (FIGS. 3 and 4). From this, the projections 13, 14 of the tangs 11, 12 are pulled out of the sparings 15,16 of the output element 8 which are provided for them. The control ring 9 simultaneously dips into recesses 27, 28 of the output element 8 with several catch elements 25, 26 and blocks its potential rotational motion (FIG. 3). The mechanical connection elements between the output element 8 and the doorlock which isn't illustrated are thereby blocked in their position.

REFERENCE NUMBER TABLE

1 lock cylinder
2 housing
3 lock channel
4 cylinder core
5 tumbler
6 cylinder liner
7 overload coupling device
8 output element
9 control element, control ring
10 longitudinal axis
11, 12 tangs
13, 14 projections
15, 16 sparings
17, 18 axial guide surfaces (control ring)
19, 20 radial guide surfaces (control ring)
21, 22 guide surfaces (cylinder liner)
23, 24 guide surfaces (tangs)
25, 26 catch elements
27, 28 recesses
29 connection element
30, 31 cam follower
32, 33 guide notches
100 spring

We claim:

1. A lock cylinder comprising:

a cylinder core rotatably mounted in a housing; and a key channel disposed within said housing;

wherein the lock cylinder is latched by a plurality of tumblers to a cylinder liner upon withdrawal of a key from the key channel, said cylinder liner arranged between the housing and the cylinder core, and wherein the lock cylinder further comprises an overload coupling device adapted to decouple a rotational drive of an output element from the cylinder core when the cylinder core is turned by an improper key or tool, wherein the overload coupling device consists of at least one radially slidable tang, non-rotatably connected to the cylinder core, said tang being supported on the output element in a radially outward direction, and adapted to engage an at least one sparing of the output element at a time, as well as adapted to cooperate with a control element in case of overload, and wherein:

a) the control element is a non-rotable control ring mounted longitudinally slidably in the housing, b) the cylinder liner comprises a plurality of diagonal guide surfaces on a side of the cylinder turned away from the key channel, said diagonal guide surfaces fashioned to axially support the cylinder liner on a plurality of corresponding surfaces of the control ring, such that the control ring slides in the direction of the output element until the control ring disengages the cylinder liner upon rotation of the cylinder liner, and c) the plurality of diagonal guide surfaces on a side of the control ring facing the tang are fashioned to support the control ring on the corresponding guide surfaces of the tang, such that the tang is pressed inwards against the pressure of a spring to release the output element upon an axial sliding of the control ring.

2. A lock cylinder according to claim 1, wherein the overload coupling device comprises at least two tangs angularly offset from each other.

3. A lock cylinder according to claim 2, wherein the control ring comprises at least one cam follower, and wherein the housing further comprises an at least one axial guide notch adapted to engage the cam follower of the control ring.

4. A lock cylinder according to claim 2, wherein the control ring comprises at least one catch element on a side of the control ring turned away from the cylinder liner, the catch element aligned with a corresponding recess of the output element, and the catch element situated in the recess, in the case of overload, when the cylinder liner and the control ring are disengaged.

5. A lock cylinder according to claim 1, wherein the control ring further comprises at least one cam follower, and wherein the housing further comprises an at least one axial guide notch adapted to engage the cam follower of the control ring.

6. A lock cylinder according to claim 5, wherein the control ring comprises at least one catch element on a side of the control ring turned away from the cylinder liner, the catch element aligned with a corresponding recess of the output element, and the catch element situated in the recess, in the case of overload, when the cylinder liner and the control ring are disengaged.

7. A lock cylinder according to claim 1, wherein the control ring comprises at least one catch element on a side of the control ring turned away from the cylinder liner, the catch element aligned with a corresponding recess of the output element, and the catch element situated in the recess, in the case of overload, when the cylinder liner and the control ring are disengaged.

8. A device comprising:

a lock liner rotatably mounted within a housing defining a longitudinal axis and a radial axis;

a lock core rotatably mounted within the liner, said core defining a key channel;

a plurality of tumblers adapted to secure the lock core to the lock liner unless a predetermined key is within the key channel;

at least one tang non-rotatably mounted on the core, adapted to selectively engage an output element; and a non-rotatable control ring mounted within the housing between the output element and the lock liner, adapted to slide longitudinally;

wherein the lock liner further comprises a guide surface adapted to engage the control ring and to slide the control ring longitudinally toward the output element when rotated;

wherein the control ring further comprises a control surface adapted to compress the tang radially when slid toward the output element; and wherein the tang is adapted to disengage the output element when compressed.

9. A device according to claim 8, wherein the lock liner and the control ring are adapted to disengage after a pre-determined rotation of the cylinder liner.

10. A device according to claim 8, comprising at least two tangs, angularly offset from each other.

11. A device according to claim 8, wherein the control ring further comprises at least one cam follower adapted to engage an at least one axial guide notch of the housing.

12. A device according to claim 8, wherein the control ring further comprises at least one catch element adapted to be positioned in a corresponding recess of the output element when the liner and the control ring are disengaged as the control ring slides toward the output element.

13. The device of claim 8 in combination with a motor vehicle wherein the motor vehicle comprises at least one door; and a locking mechanism in the at least one door having said device.

14. A device comprising:

a lock liner rotatably mounted within a housing defining a longitudinal axis and a radial axis;

a lock core rotatably mounted within the liner, said core defining a key channel;

a plurality of tumblers adapted to secure the lock core to the lock liner when an improper key is within the key channel;

at least two tangs, angularly offset from each other, non-rotatably mounted on the core, adapted to selectively engage an output element; and a non-rotatable control ring mounted within the housing between the output element and the lock liner, adapted to slide longitudinally, the control ring having (a) at least one cam follower adapted to engage an at least one axial guide notch of the housing, and (b) at least one catch element adapted to be positioned in a corresponding recess of the output element when the liner and the control ring are disengaged as the control ring slides toward the output element;

wherein the lock liner further comprises a guide surface adapted to engage the control ring, to slide the control ring longitudinally toward the output element when rotated, and to disengage the lock liner from the control ring after a pre-determined rotation of the cylinder liner;

wherein the control ring further comprises a control surface adapted to compress the tang radially when slid toward the output element; and wherein the tang is adapted to disengage the lock core from the output element when compressed.

* * * * *